United States Patent [19]

Perrin et al.

[11] 3,935,802

[45] Feb. 3, 1976

[54] CONSTRUCTION AND METHOD OF DISPENSING CRIMPED PAPER TOWELING

[75] Inventors: Jack Louis Perrin, Los Angeles; Stanley Theodore Christensen, San Gabriel, both of Calif.

[73] Assignee: Towlsaver, Inc., Los Angeles, Calif.

[22] Filed: July 30, 1974

[21] Appl. No.: 493,349

[52] U.S. Cl. ..... 93/84 R; 225/16

[51] Int. Cl.[2] ..... B31D 5/04; B65H 45/16

[58] Field of Search ..... 225/10, 16, 39, 46, 47; 93/84 R

[56] References Cited

UNITED STATES PATENTS

| | | | |
|---|---|---|---|
| 486,102 | 11/1892 | Goff | 225/47 X |
| 486,103 | 11/1892 | Goff | 225/47 X |
| 2,839,345 | 6/1958 | Engel et al. | 225/16 |
| 2,888,180 | 5/1959 | Kinker | 225/39 |
| 3,045,885 | 7/1962 | Dahlin et al. | 225/16 X |

*Primary Examiner*—Stanley H. Tollberg
*Assistant Examiner*—Francis J. Bartuska
*Attorney, Agent, or Firm*—Mahoney, Schick & Cislo

[57] ABSTRACT

A supply web of relatively smooth paper toweling is mounted on a dispenser and is directed between rotatable dispensing rolls which have interengaging generally triangular teeth. The dispensing rolls are resiliently urged together with the paper toweling web therebetween and during roll rotation, the teeth compressively abut and foldably deform the relatively smooth paper web into a crimped paper web without appreciable permanent thickness deformation. During the crimping of the paper web by the dispensing rolls and without regard to roll rotation, the paper web is at all times securely retained by the rolls so that after the dispensing of a desired length of the crimped paper web, the web may be cut along a dispenser cutting bar during such roll retention.

6 Claims, 7 Drawing Figures

CONSTRUCTION AND METHOD OF DISPENSING CRIMPED PAPER TOWELING

BACKGROUND OF THE INVENTION

This invention relates to a unique dispenser which forms a supply web of relatively smooth paper toweling of somewhat usual form into a web of crimped paper toweling during the dispensing operation so that the paper toweling web received from the dispenser is in such crimped form. The result is that the dispensed crimped paper toweling web has a much improved softer or fluffier feel with inherently better absorbent and wiping qualities, all without any sacrifice of moisture strength of the paper toweling web.

Furthermore, during the crimping operations, the paper toweling web is at all times securely gripped by the dispensing rolls, whether the rolls are rotating or stationary, so that the paper web is always totally controlled by the dispensing rolls and the paper web will be retained secure at termination of a dispensing operation for more positive severance of the paper web from the dispenser, for instance, by a usual cutting bar.

One of the major goals sought in prior paper toweling dispensers has always been the dispensing of paper toweling of a maximum softness or fluffiness with a certain amount of roughness so that the surface thereof is more pleasing to the human touch while still having a maximum of wiping qualities. Obviously, this can be accomplished by using a more porous and thicker paper toweling web, but this obvious solution is objectionable from two major standpoints. Firstly, if the paper toweling web is thicker, less total length of paper toweling can be stored at one time in the storage area of a given size of dispenser, thereby requiring more frequent replenishment of such supply. Secondly, by providing a more porous and thicker paper toweling web, there most frequently is a sacrifice of toweling moisture strength resulting in a difficulty in wiping use. Thus, there is a long-felt need and want for a paper towelling web having all of the required strength and size qualities of present paper toweling, yet has a softer, fluffier feel more pleasing to the human senses.

One basic requirement of all modern paper toweling dispensers is the maximum firmness of retention of the paper toweling web in the dispenser during severance of the paper web after a length of paper web has been so dispensed. Whether the paper toweling web is perforated at spaced locations predicated for tearing or is continuous and requires a dispenser cutting bar for such severance, it still must be retained firmly in order that a relatively straight torn edge is accomplished transversely or normal to the extension of the paper web to separate the length of paper web from the dispenser. Many of the prior paper toweling dispensers have been found to be deficient in this respect.

It is fundamental that the rotatable dispensing rolls of a dispenser must be formed of relatively rigid material, such as wood, metal or plastic, in order to perform their function of smoothly drawing the paper toweling web from the supply within the dispenser and directing the same in a continuous web from the dispenser, ultimately to be transversely severed for use. Furthermore, in order to properly grip and linearly move the paper toweling web, the radially abutting dispensing rolls have usually been radially pressed together by some form of resilient means so that tight abutment is accomplished against the paper toweling web extending therebetween. This resilient pressing together of the dispensing rolls against the paper toweling web, however, using plain surfaced dispensing rolls has always presented the problem of lack of firm retention of the web throughout the transverse width thereof when the rolls are stationary and during the required transverse severing of the dispensed portion of the web. Whether such transverse severing of the dispensed portion of paper toweling web is accomplished at pre-perforated sections of the web or against a usual cutting bar, the required forces for severance will frequently pull an additional portion of the web at one side of the dispensing rolls through the rolls causing an irregular severed edge rather than the desired perfectly straight severed edge.

In order to overcome this problem, various attempts have been made to add resilient gripping strips or covering strips over the necessarily rigid surfaced dispensing rolls, and even the provision of such gripping strips or covers with roughened resilient surfaces including radial slotting and other forms of resilient material surface patterns, all for the purpose of providing a more firm gripping and retention of the paper toweling web between the dispensing rolls. Even attempts to use sandpaper-like surfaces have been attempted but despite all of these prior attempts to improve the gripping qualities of the dispensing rolls, a total solution to the problem has not been heretofore presented.

OBJECTS AND SUMMARY OF THE INVENTION:

It is, therefore, an object of this invention to provide a dispenser for dispensing a paper toweling web from a dispenser paper web supply of usual, relatively smooth paper which, during the usual dispensing operation by use of radially abutting, rotatable dispensing rolls, the relatively smooth paper supply web is automatically formed into a distinctively crimped paper toweling web, all without appreciable permanent thickness restriction or deformation. The ultimately dispensed paper toweling web, therefore, as a result of the distinctive crimping thereof, has a vastly improved softer, fluffier feel with inherently improved absorbent and wiping qualities. Despite this improved fluffier textured feel, however, due to the lack of appreciable permanent thickness restriction or deformation, the same moisture strength is retained.

It is a further object of this invention to provide a dispenser which automatically accomplishes the foregoing unique paper toweling web crimping action during the dispensing operation by use, in the preferred form, of interengaging dispensing rolls against the paper toweling web therebetween to foldably deform the paper web into the crimped paper web ultimately dispensed from the dispenser, all in a usual dispensing roll rotation with the use of the conventional lever or crank actuated dispensing operations. Preferably, radially opposed dispensing roll projections and depressions interengage against the paper toweling web during the movement of the paper web from the dispenser supply thereof through the dispensing rolls and ultimately from the dispenser, such interengaging projections and depressions automatically performing the foldable deformation operation so that no additional components are required. Thus, the unique crimping action of the paper toweling web without appreciable thickness restriction or deformation is automatically performed and automatically results in the unique dispensed end product having all of the advantages heretofore pointed out.

It is still a further object of this invention which, again in the preferred form, automatically accomplishes the foregoing unique paper toweling web crimping action during web dispensing by use of dispensing rolls each having a multiplicity of generally axially extending teeth formed thereon, the teeth preferably being generally triangular in radial cross-section. Furthermore, with the dispensing roll teeth forming the previously indicated projections, the depressions are formed by generally triangular voids circumferentially between the teeth as defined by the teeth sides. Thus, by radial abutment of the dispensing rolls causing radial interengagement of the teeth, one roll into the other during the roll rotation and with the paper toweling web compressively abutted therebetween, the paper web is foldably deformed over each of the respective roll teeth during the dispensing operation resulting in the uniquely crimped final paper toweling web form.

It is an additional object of this invention to provide a dispenser of the foregoing general type and which automatically forms relatively smooth paper toweling into uniquely crimped paper toweling wherein the paper toweling web moving between the dispensing rolls and being automatically so crimped is, in the preferred arrangement, firmly compressively gripped at all times regardless of dispensing roll rotation or stationary positioning, preferably by dispensing roll interengagement. As a result, at the termination of a particular dispensing operation when the dispensing rolls cease rotation, the portions of the paper toweling web dispensed may be severed or cut transversely for separation from the dispenser in a clean, straight edge during such firm retention and whether along a pre-perforated line or against a usual cutting bar. At the same time, and also due to such firm retention of the paper toweling web, such web cannot be improperly drawn through the dispensing rolls without dispensing roll rotation and with conventional "anti-milking" mechanisms associated with the dispensing rolls, the paper toweling web can only be removed by a proper dispensing action.

Other objects and advantages of the invention will be apparent from the following specification and the accompanying drawings which are for the purpose of illustration only.

DESCRIPTION OF THE BEST EMBODIMENT CONTEMPLATED

Figure 1:
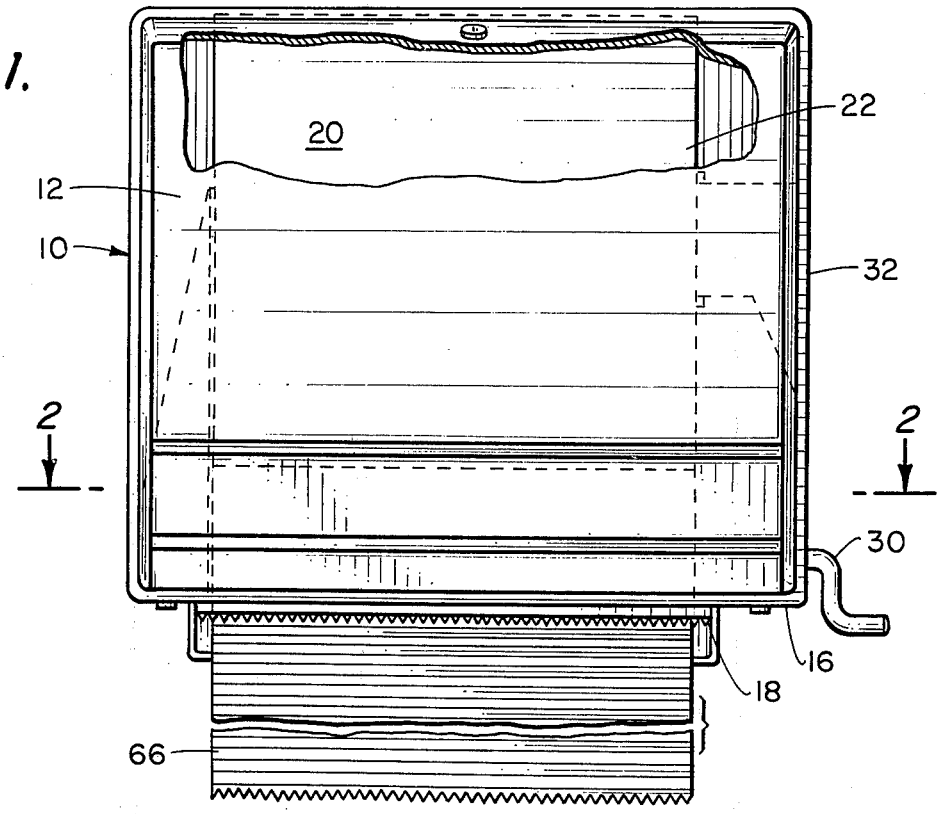
FIG. 1 is a front elevational view of a paper toweling dispenser incorporating an embodiment of the unique principles of the present invention therein, a portion of the dispenser front cover being broken away to expose a dispenser supply roll of conventional, relatively smooth paper toweling.

Referring to FIG. 1 of the drawings, a paper toweling dispenser is shown incorporating an embodiment of the principles of the present invention. For the main part, the dispenser is of a usual construction and is illustrated and described herein to form a typical environment for application of the novel improvements of the present invention. In general, therefore, the dispenser is formed of conventional materials and by usual manufacturing processes except as hereinafter specifically pointed out relative to the inventive principles involved. Furthermore, it should be kept in mind that the basic dispenser structure is purely illustrative and that the novel principles of the present invention can be equally applied to dispensers and similar structures of various other forms, all of which will be more apparent from the following description.

Still further, as used herein, the terms "relatively smooth" or "plain" or "usual" as referring to the paper toweling or paper toweling web are intended to mean paper toweling as normally used in the trade. Paper toweling as normally used in the trade is smooth in the sense that it is uncrimped, although it does not have a smooth hardened surface, but rather a slightly roughened or slightly creped surface so as to be somewhat soft textured and moisture absorbent.

Figure 4:
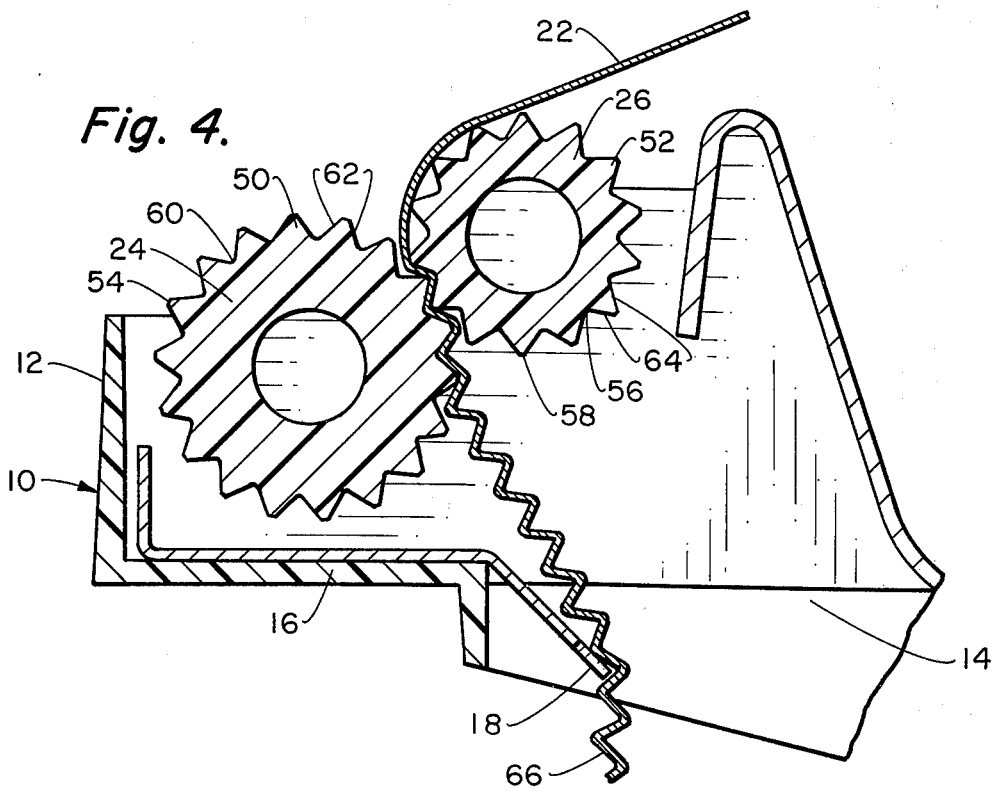
FIG. 4 is an enlarged, fragmentary, vertical sectional view looking in the direction of the arrows 4—4 in FIG. 3.

As shown in FIG. 1, the dispenser includes a box-like cabinet generally indicated at 10 having the front wall 12 thereof separable and hingedly connected in usual manner for access to the cabinet interior. A usual transversely elongated dispensing slot 14 is formed through a cabinet bottom wall 16 as shown in FIG. 4. Furthermore, a usual cutting bar 18 is secured to the bottom wall 16 and projects rearwardly from the front edge of the dispensing slot 14 into such dispensing slot for severing toweling after dispensing from the cabinet 10 as will be discussed hereinafter more in detail.

Figure 2:
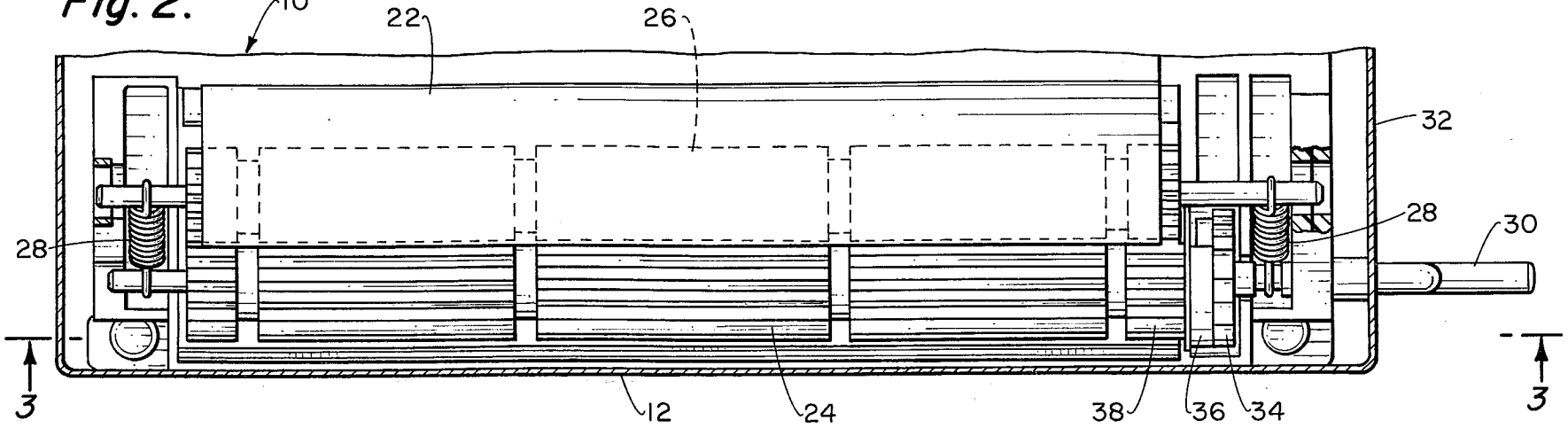
FIG. 2 is an enlarged, fragmentary, horizontal sectional view looking in the direction of the arrows 2—2 in FIG. 1.
Figure 3:
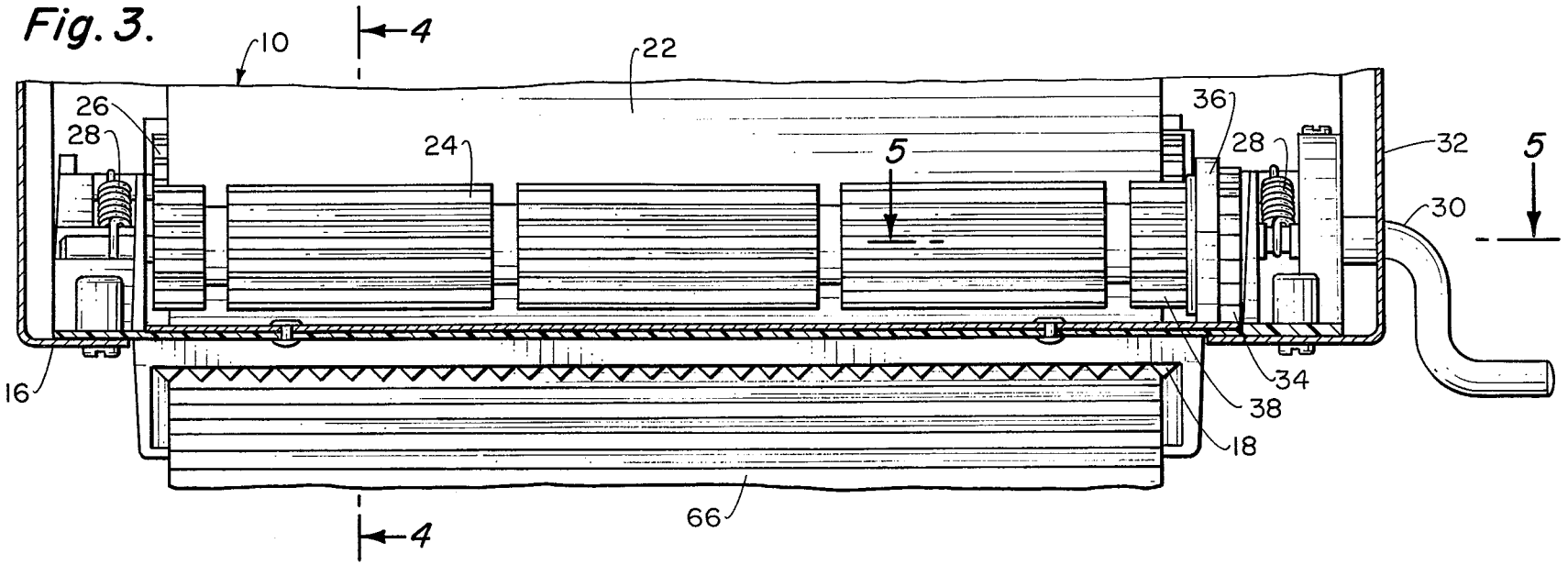
FIG. 3 is a fragmentary, vertical sectional view looking in the direction of the arrows 3—3 in FIG. 2.

As can be seen in FIG. 1, at the upper portion of the interior of the cabinet 10 is rotatably mounted a supply roll 20 of usual, plain, relatively smooth or uncrimped paper toweling web 22 which web is directed downwardly within the cabinet between a set or pair of dispensing rolls comprised of a drive roll 24 and a driven roll 26 seen in radial cross-section in FIG. 4, and in plan and elevational views in FIGS. 2 and 3 respectively. As again is somewhat usual, the drive roll 24 is journaled in the cabinet 10 rotatable about a radially stationary axis while the driven roll 26 is radially resiliently pressed into abutment against the drive roll by tension springs 28 so that the driven roll is rotatably driven by the drive roll through such resilient abutment. In this particular instance, the drive roll 24 is selectively rotatably driven by a hand actuated crank 30 journaled through a right-hand side wall 32 of the cabinet 10.

Figure 5:
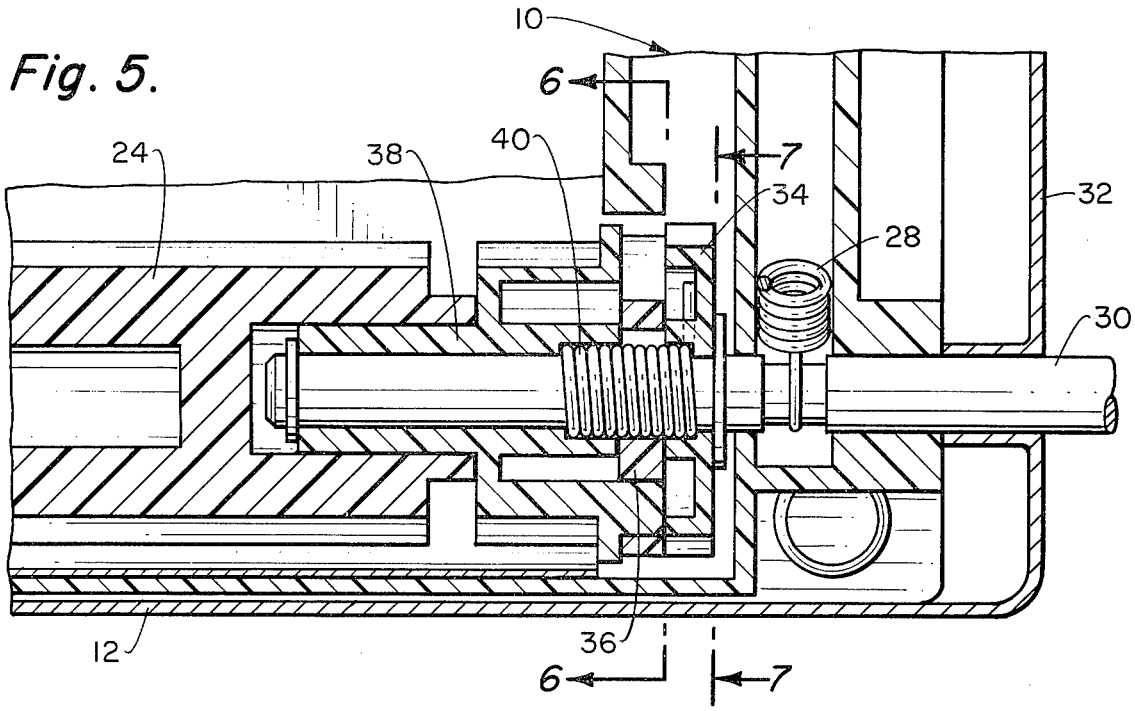
FIG. 5 is an enlarged, fragmentary vertical sectional view looking in the direction of the arrows 5—5 in FIG. 3.
Figure 6:
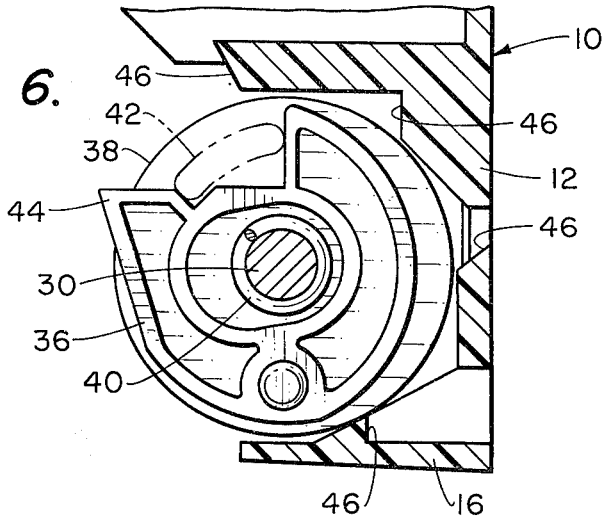
FIG. 6 is a fragmentary, vertical sectional view looking in the direction of the arrows 6—6 in FIG. 5.
Figure 7:
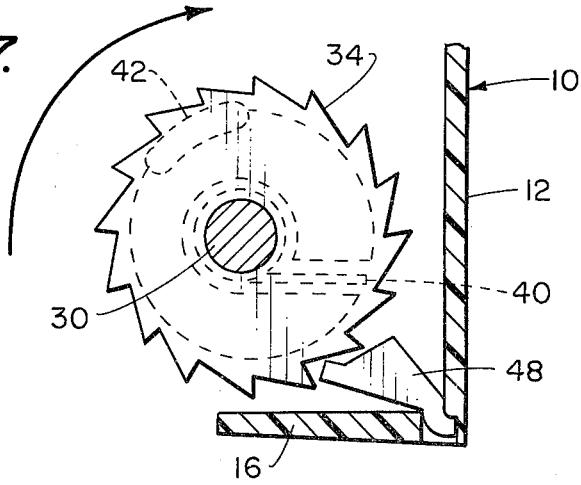
FIG. 7 is a fragmentary, vertical sectional view looking in the direction of the arrows 7—7 in FIG. 5.

As can be seen in cross-section in FIG. 5, the hand crank 30 projects from the cabinet side wall 32 through engagement by one of the tension springs 28, through a ratchet wheel 34, through an anti-milking cam 36 and through a drive roll cap or hub 38, being journaled in all of these elements with the exception of the anti-milking cam and being merely spaced radially inwardly from such anti-milking cam. A clutch spring 40 surrounds a portion of the hand crank 30 within the ratchet wheel 34, the anti-milking cam 36 and the drive roll hub 38 with this spring merely being circumferentially tensioned about the hand crank but having its right end or tail engaged with the ratchet wheel as shown in FIGS. 5 and 7. The ratchet wheel 34, near its periphery, is formed with a drive dog 42 projecting axially into engagement with the anti-milking cam 36 as shown in FIGS. 6 and 7. Completing the chain of drive elements, the anti-milking cam 36 is radially pivotally pin-connected to the drive roll hub 38 as shown in FIGS. 5 and 6, the anti-milking cam being shown in FIG. 6 pivoted radially outwardly into anti-milking position ready for its engagement dog 44 to engage any one of four stationary stops 46 formed on the cabinet 10.

Briefly, in normal rotation of the drive roll 24 clockwise as viewed in FIG. 4, clockwise rotation of the hand crank 30 causes the hand crank to wind and tighten the clutch spring 40 thereabout transferring motion frictionally and rotating the ratchet wheel 34 clockwise as viewed in FIG. 7 with a ratchet dog 48 sliding over the teeth of the ratchet wheel in usual manner. Clockwise rotation of the ratchet wheel 34 causes the drive dog 42 thereof to radially pivotally retract by circumferential abutment the anti-milking cam 36 as well as rotatably drive the anti-milking cam in the clockwise direction as viewed in FIG. 6. Such clockwise rotation of the anti-milking cam 36 is, in turn, transmitted to drive roll hub 38 through the pin pivotal connection therebetween and with the drive roll hub being secured to the drive roll 24, the drive roll is rotated clockwise (FIG. 4).

If reverse or counter-clockwise rotation of the hand crank 30 is attempted, certain of this counter-clockwise rotation is transmitted through the clutch spring 40 to the ratchet wheel 34 with this counter-clockwise rotation of the ratchet wheel being resisted by the ratchet 48 engaging one of the teeth of the ratchet wheel. Consequently, the ratchet wheel 34 and ratchet 48 also resist counter-clockwise rotation of the anti-milking cam 36, the drive roll hub 38 and the drive roll 24. Upon the locking of the ratchet wheel 34, continued reverse rotation of the hand crank 30 unwinds the clutch spring 40 causing slippage on the hand crank. Furthermore, if "milking" of the dispenser is attempted, that is, the pulling of the paper web from the dispenser without properly driving the drive roll 24, the attempted clockwise rotation of the drive roll through the drive roll hub 38 causes the anti-milking cam 36 to be pivoted outwardly to the position shown in FIG. 6 by the ratchet wheel drive dog 42, with the engagement dog 44 of the anti-milking cam ultimately engaging one of the stationary stops 46 on the cabinet 10 to stop all further drive roll rotation. Thus, with the particular drive arrangement, normal dispensing is permitted by clockwise rotation of the hand crank 30, while reverse improper rotation of the hand crank is stopped by the ratchet wheel 34, and improper milking of the paper toweling web from the cabinet 10 is stopped by the anti-milking cam 36.

More particularly to the unique principles of the present invention, as shown in detail in FIGS. 2, 3 and 4, each of the drive roll 24 and driven roll 26 are formed on the peripheries thereof with a multiplicity of generally axially extending and preferably circumferentially adjacent projection means or serration means or teeth, the teeth of the drive roll 24 being indicated at 50 and the teeth of the driven roll 26 being indicated at 52. Furthermore, the teeth 50 of the drive roll 24 and the teeth 52 of the driven roll 26 are formed matching so that the drive and driven roll teeth perfectly interengage during the continued rotation of the drive and driven rolls, the driven roll being radially resiliently urged against the drive roll by the tension springs 28 as hereinbefore described. Thus, during rotation of the drive and driven rolls 24 and 26, crests 54 of the drive roll teeth 50 fully engage radially into valleys 56 circumferentially between the driven roll teeth 52, while at the same time, crests 58 of the driven roll teeth 52 fully engage in valleys 60 circumferentially between the drive roll teeth 50, all as clearly shown in FIG. 4.

The teeth 50 of the drive roll 24 are preferably all formed with flat sides 62 and the teeth 52 of the driven roll 26 are likewise preferably all formed with flat sides 64. All of the teeth 50 and 52 on the drive and driven rolls 24 and 26 are, therefore, generally triangular in radial cross-section. Also, these teeth 50 and 52 being circumferentially adjacent form generally triangular valleys 60 and 56 therebetween.

Now with the plain paper toweling web 22 extending into abutment between the resiliently pressed drive and driven rolls 24 and 26, as these rolls rotate, the drive roll clockwise and the driven roll counter-clockwise as viewed in FIG. 4, the crests 54 of the drive roll teeth 50 compressively abut the paper toweling web at the valleys 56 between the driven roll teeth 52 and the crests 58 of the driven roll teeth 52 compressively abut the paper toweling web in the valleys 60 between the drive roll teeth 50. Since the driven roll 26 is driven by the drive roll 24, also during such rotation, the flat sides 62 on the circumferentially leading sides of the drive roll teeth 50 must transmit rotation circumferentially against the flat sides 64 on the circumferentially trailing sides of the driven roll teeth 52, thereby compressively abutting the paper toweling web 22 at these teeth locations. Still further, and again for the reason that the drive and driven rolls 24 and 26 are constantly resiliently radially pressed together and with the teeth formed for relatively perfect interfitting, there will be some compressive engagement of the paper toweling web 22 between the trailing of the flat sides 62 on drive roll teeth 50 and the leading of the flat sides 64 on driven roll teeth 52.

The net important effect is that as the plain or smooth paper toweling web 22 is drawn through and variously compressively abutted between the drive roll teeth 50 and the driven roll teeth 52, and over the various crests 54 and 58 of these teeth, the plain paper toweling web is foldably deformed into a crimped or serrated paper toweling web 66 as illustrated in FIGS. 1, 3 and 4. It is important, however, for obtaining the optimum benefits of the crimping action of the present invention to properly select and coordinate all of the dispensing roll radial resilient pressing, the interengagement of the dispensing roll teeth, the forces to be transmitted between the rolls for cooperable rotation and the thickness and texture of the paper toweling web so that there is no appreciable permanent thickness deformation of the smooth paper toweling web 22 during the crimping or serration conversion into the crimped paper toweling web 66. If the compressive abutment forces resulting from all of these factors in coordination results in any appreciable degree of permanent thickness deformation or permanent compression, the paper toweling web will be hardened or stiffened and will not have the optimum increased softness or fluffiness feel to the human senses. If, however, the various forces are properly coordinated, the crimping or serrating action of the dispensing rolls will produce the increased softness or fluffiness results with the increased roughness or irregularity for improved wiping and absorbent qualities.

It is pointed out that if it is desired to form the set of dispensing rolls, the drive roll 24 and the driven roll 26 in axial sections with circumferential or annular slots therebetween as illustrated in FIGS. 2 and 3, for instance, for purposes of installing guides (not shown) or for any other purpose, it has been found that such can be done without appreciably disturbing the transversely continuous formation of the creases or folds or serrations to produce the crimped paper toweling web 66. With the slight width of the slots between the roll sections as shown, the radially interengaging teeth 50 and 52 of the drive and driven rolls 24 and 26 will form such creasing or folding and the creasing or folding will carry axially across the voids between the roll sections with the final crimped paper toweling web 66 having virtually uninterrupted creases or folds transversely across the entire width thereof.

More important to the unique principles of the present invention, due to the various compressive abutments of the drive and driven rolls 24 and 26 against the smooth paper toweling web 22 during the formation thereof into the crimped paper toweling web 66, the paper toweling web will be at all times firmly compressively gripped by the drive and driven rolls and particularly important when these rolls are rotatably stationary. For this reason, when a length of the crimped paper toweling web 66 has been dispensed from the cabinet 10 and is extending downwardly from the drive and driven rolls 24 and 26 through the dispensing slot 14 adjacent the cutting bar 18, the crimped paper toweling web may be grasped by hand and pulled forwardly against the cutting bar 18 to sever the same from that portion still within the dispenser or cabinet. During such severing against the cutting bar 18, the paper toweling web still within the cabinet 10 is firmly gripped or retained by the drive and driven rolls 24 and 26 so that the tear or severing against the cutting bar 18 will always be transversely straight across the width of the paper toweling web.

As a practical example of drive and driven rolls 24 and 26 used for carrying out the principles of the present invention, the drive and driven rolls may be formed of plastic such as polystyrene having axial lengths of approximately 7 inches. The drive roll 24 may have 18 equally spaced teeth 50 with flat crests 54 of approximately 15 thousandths inches in circumferential width and 15 thousandths inches radius at the valleys 60, flat sides 62 extending between a maximum diameter of approximately 95/100s of an inch and a minimum diameter of approximately 80/100s of an inch. The driven roll 26 has 14 equally spaced teeth 52, a flat at crest 58 of 15 thousandths inches, a radius at valleys 56 of 15 thousandths inches and flat sides extending between a maximum diameter of approximately 74/100s of an inch and a minimum diameter of approximately 60/100s of an inch. As stated, the resilient urging force of the tension springs 28 urging the drive and driven rolls 24 and 26 radially together is coordinated with the force required by the drive roll 24 against the idling driven roll 26 to rotate the same for the dispensing and the texture and thickness of the smooth paper toweling web 22 to produce the crimped paper toweling web 66 preferably without appreciable permanent thickness deformation.

According to the principles of the present invention, therefore, a construction of dispenser and a method of dispensing are herein provided wherein a supply web of relatively smooth or plain or uncrimped paper toweling of somewhat usual form is converted into a web of crimped paper toweling automatically during the dispensing operation. The resultant paper toweling web received from the dispenser in this uniquely crimped condition has vastly improved softer and fluffier qualities very apparent to the human senses, as well as improved absorbent and wiping qualities without any sacrifice of moisture strength. Furthermore, after a desired length of the uniquely crimped paper toweling web has been dispensed, the connected end thereof is at all times firmly and securely retained by the dispenser so that the dispensed web portion may be cleanly severed for use.

We claim:

1. In a dispenser of the type having a paper toweling supply directing a web of paper toweling between a radially abutting, selectively rotatably driven set of dispensing rolls and from the dispenser for dispensing the paper toweling web; the improvements comprising: mounting means mounting at least one of said dispensing rolls radially movable relative to the other of said dispensing rolls; resilient means operably connected constantly resiliently urging said dispensing rolls radially into said roll abutment; each of said dispensing rolls having a plurality of generally axially extending teeth uniformly about a circumference thereof, said teeth of each dispensing roll in radial cross-section being generally triangular with sides converging to crests and diverging to valleys forming voids therebetween; said teeth of each dispensing roll at said roll abutment and during said roll rotation fully matching and fully interengaging said teeth of the other dispensing roll against said paper web therebetween as urged by said resilient means, each of said teeth crests of each of said dispensing rolls engaging fully and forcing said paper web fully into and against said teeth valleys of each of said dispensing rolls; surface means on said teeth having portions thereof at all times compressively abutting said paper web regardless of the rotatable positioning of said rolls and without regard to said roll rotation as urged by said resilient means resisting movement of said paper web through said dispensing rolls without roll rotation; said interengaged teeth of said dispensing rolls at said roll abutment as resiliently urged and during said roll rotation cooperating to compressively abut and relatively sharply permanently foldably deform said paper web over said teeth crests and fully inwardly against said teeth valleys to permanently foldably crimp said paper web; said dispensing rolls during said roll rotation dispensing said relatively sharply folded crimped paper web from said dispenser.

2. In a dispenser as defined in claim 1 in which all of said teeth of said dispensing rolls include relatively flat crests with radiused valleys therebetween permitting said paper web relatively sharp permanent folding without appreciable permanent thickness deformation.

3. In a dispenser as defined in claim 1 in which one of said dispensing rolls is a driver roll selectively rotatably driven during said roll rotation and the other of said dispensing rolls is an idler roll rotatably driven by said driver roll during said roll rotation by said interengagement of said dispensing roll teeth as constantly urged into abutment by said resilient means assisting in said teeth surface means portions at all times maintaining said paper web compressive abutment.

4. In a method of dispensing a web of paper toweling from a dispenser; the steps of: mounting a supply web of paper toweling on the dispenser; directing said paper toweling web between matching, generally triangular, axially extending and interengaged teeth of circumferentially abutting and resiliently radially biased rotatable dispensing rolls by rotation of said dispensing rolls; during said rotation of said dispensing rolls, repeatedly relatively sharply permanently foldably deforming said paper toweling web into a relatively sharply permanently folded crimped paper toweling web at spaced locations therealong through full interengagement of crests of roll generally triangular matching teeth fully into and against valleys of roll generally triangular voids between matching teeth with said paper toweling web compressed therebetween and as augmented by said roll radial biasing; regardless of roll rotation, maintaining surface portions of roll interengaged teeth at all times compressively abutting said paper toweling web as augmented by said roll radial biasing; during said rotation of said dispensing rolls, dispensing said permanently folded crimped paper toweling web from said dispenser.

5. In a method of dispensing as defined in claim 4 in which said step of relatively sharply permanently foldably deforming said paper toweling web includes the compressively abutting and permanently foldably deforming said paper toweling web during said roll rotation into said permanently folded crimped paper toweling web without appreciable thickness deformation by engaging relatively flat crests of said generally triangular matching teeth fully into radiused valleys of said generally triangular voids between said matching teeth.

6. In a method of dispensing as defined in claim 4 including the further step of rotatably driving said dispensing rolls by rotatably driving one of said dispensing rolls and transmitting said rotational drive to the other of said dispensing rolls through said dispensing roll interengaged teeth to further augment said compressive abutment of said paper toweling web by said interengaged teeth.

* * * * *